US005575402A

United States Patent [19]

Botsolas

[11] Patent Number: 5,575,402

[45] Date of Patent: Nov. 19, 1996

[54] TANK HEAD INSULATION COVERS

[75] Inventor: Christos J. Botsolas, Clearwater, Fla.

[73] Assignee: Carol M. Botsolas, Clearwater, Fla.

[21] Appl. No.: 406,631

[22] Filed: Mar. 20, 1995

Related U.S. Application Data

[63] Continuation of Ser. No. 243,732, May 17, 1994, abandoned, which is a continuation of Ser. No. 921,859, Jul. 29, 1992, abandoned.

[51] Int. Cl.[6] ..... B65D 90/02

[52] U.S. Cl. ..... 220/565; 220/412; 220/200

[58] Field of Search ..... 220/565, 567, 220/4.12, 200

[56] References Cited

PUBLICATIONS

TIAC Times–Mar. 1992.

*Primary Examiner*—Joseph M. Moy
*Attorney, Agent, or Firm*—Hedman, Gibson & Costigan, P.C.

[57] ABSTRACT

A tank head insulation cover comprising a plurality of generally wedge shaped panels with flanges, the panels being assembled in an overlapping manner onto the tank head so the flanges are in close relation to the perimeter of the tank. A center cap is provided to cover the area left uncovered by the panels.

13 Claims, 6 Drawing Sheets

TANK HEAD INSULATION COVERS

This is a file wrapper continuation of Ser. No. 08/243,732, filed May 17, 1994 which is a file wrapper continuation of Ser. No. 07/921,859 filed Jul. 29, 1992, now abandoned.

FIELD OF THE INVENTION

This invention relates generally to tank head insulation covers, and in particular to tank head insulation covers which can be easily assembled and readily adapted to conform to tank heads of a variety of different shapes and sizes.

BACKGROUND OF THE INVENTION

In the prior art, tank heads are insulated with cut and scored pieces of insulation block. The insulation block is covered with hexagonal wire, cemented with one or two coats of insulation cement, and finished with fiberglass cloth and troweled-on mastic for waterproofing.

Aluminum sheeting, which is used to cover the tank body insulation, has also been used to cover the tank head insulation. This method is advantageous since the cementing applications required when using insulation block are eliminated.

FIG. 1 shows aluminum wedge shaped sections, called gores, used in the prior art to cover insulated tank heads. The tank shown in FIG. 1 has an outside diameter of approximately 12' and may contain as many as 52 gores screwed together. Each gore is approximately 10" wide at its widest end, curves slightly to conform to the tank head. Each gore is arranged so as to overlap the adjacent gore by approximately 2'. After all the gores are secured to the tank, an area approximately 12" or more in diameter in the center of the tank head remains exposed. A round aluminum disc is therefore applied to this uncovered area and secured to the assembly of gores.

Gores are fabricated from flat sheets of aluminum stock. A large number of gores of relatively small width must be utilized in order for the gore flanges to conform closely to the circumference of the tank head and thus reduce the chance of leaking overlap joints. The assembly of this large number of gores to a tank head is very time consuming, and it is difficult to align the gores properly. The error introduced by one misaligned gore is amplified considerably as the remaining gores are installed.

In addition, the large number of seams between the gores is disadvantageous since these seams have been known to leak during rainstorms or tank washdowns. The large number of seams is also disadvantageous since each seam is a potential entryway for dirt, mildew and insects. This is especially, problematic for food and beverage storage tanks.

Moreover, movement of the gores is inevitable since caulking compounds are generally not used in the prior art.

It is therefore an object of the present invention to provide a tank head insulation cover formed from a small number of panels which conforms closely to the circumference of the tank.

It is a further object of the present invention to provide a tank head insulation cover which is lightweight and easy to install.

It is a further object of the present invention to provide a tank head insulation cover which can be adapted to be fitted to tank heads of a variety of shapes and sizes.

SUMMARY OF THE INVENTION

In accordance with these and other objects, provided is a tank head insulation cover comprising a plurality of panels, the shape of each panel defined by a pair of sides joined at one end by a convex base and converging towards an adjoining inner base, the convex base conforming substantially to an arc along the circumference of the tank head, the panels arranged adjacently so as to substantially cover the tank head, and a cap for covering the center area of the tank head left uncovered by design, after fastening the plurality of panels. Each panel can comprise a flange along the convex base which extends obliquely from the panel and is conformed to the perimeter of the tank.

By providing wide enough panels, the panels can overlap along the radial edges and the seams can be caulked to form a waterproof fit. In addition, the overlap allows the panels to be pulled outwardly from the center and subsequently cover a tank head with a larger diameter. This allows a set of panels of one size to be implemented with tank heads of varying insulation thicknesses and sizes.

BRIEF DESCRIPTION OF THE DRAWING

A better understanding of the present invention as well as other objects and advantages thereof will become apparent upon consideration of the detailed disclosure thereof especially when taken with the accompanying drawings wherein.

DESCRIPTION OF THE PREFERRED EMBODIMENT

Figure 1:
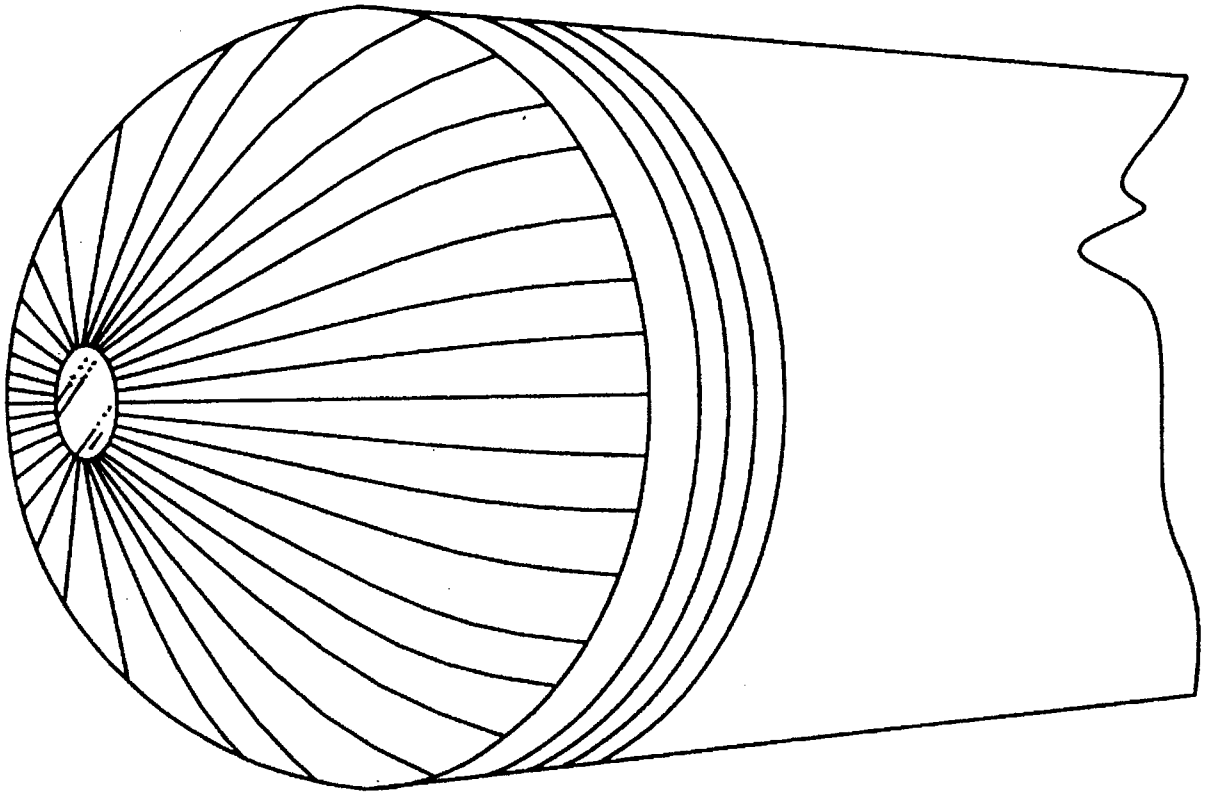
(PRIOR ART) FIG. 1
FIG. 1 is pictorial of a tank head insulation cover of the prior art.
Figure 2:
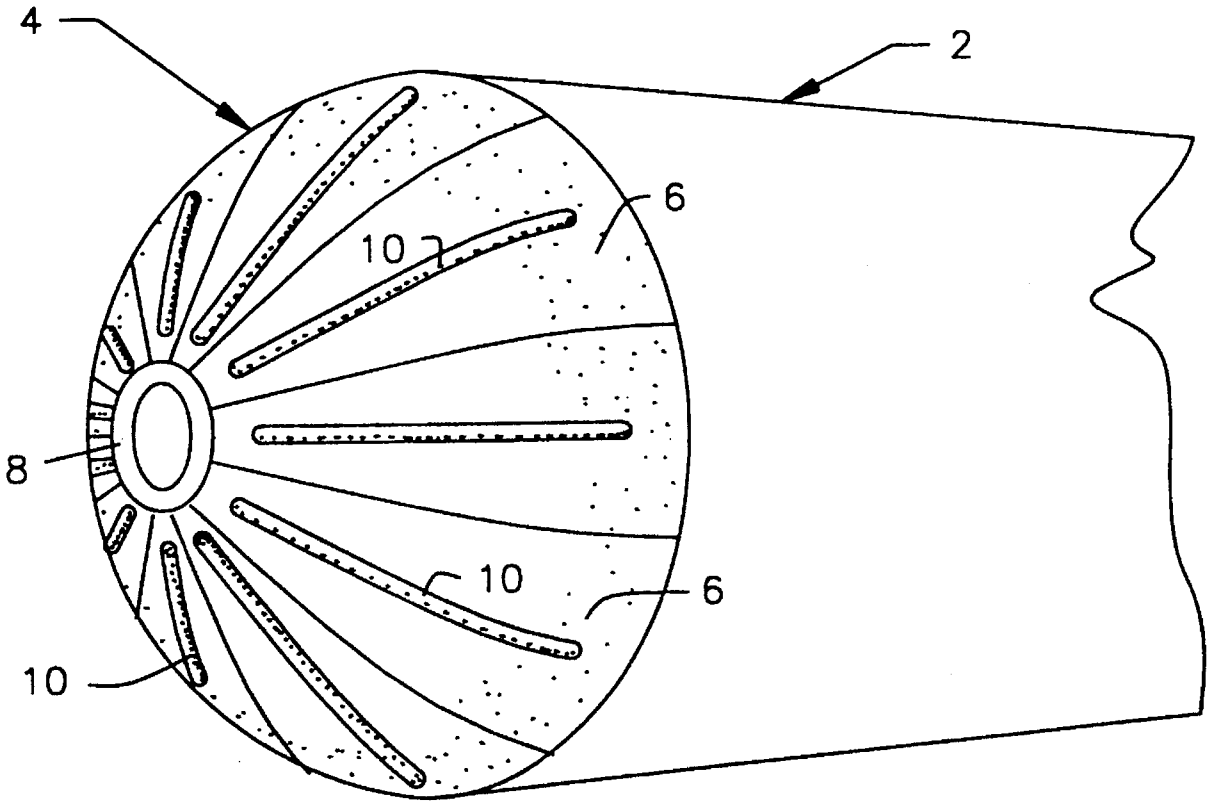
FIG. 2 is a perspective view of a tank comprising the tank head insulation cover of the preferred embodiment of the present invention.
Figure 3:
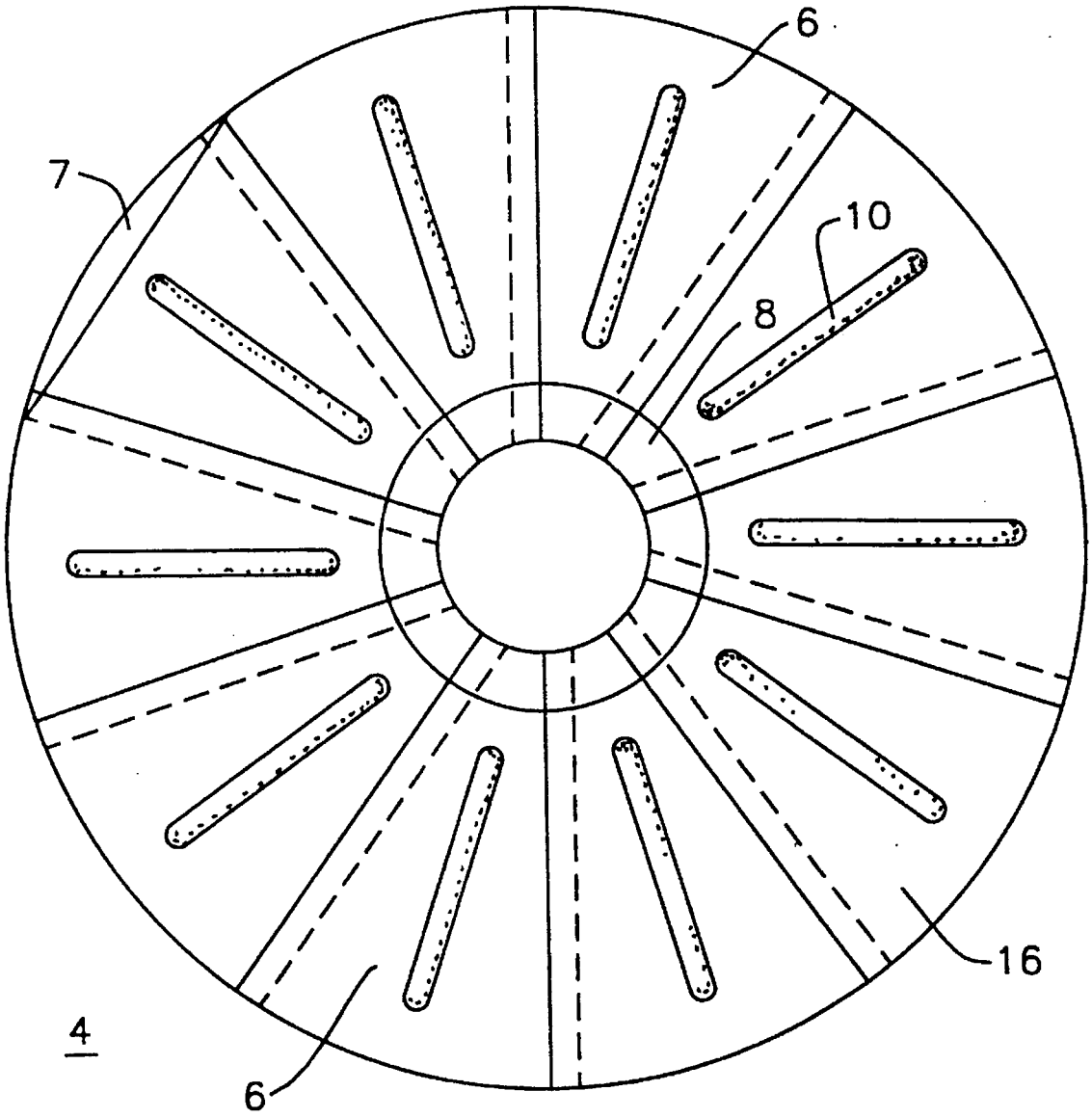
FIG. 3 is a top plan view of the tank head insulation cover of FIG. 2.

The preferred embodiment of the present invention will now be described in detail. The tank head insulation cover 4 of the preferred embodiment is shown installed onto a first end of a tank 2 in FIG. 2. As illustrated in FIG. 3, the head cover 4 is comprised of ten identical panels 6 and a circular cap 8.

Figure 4:
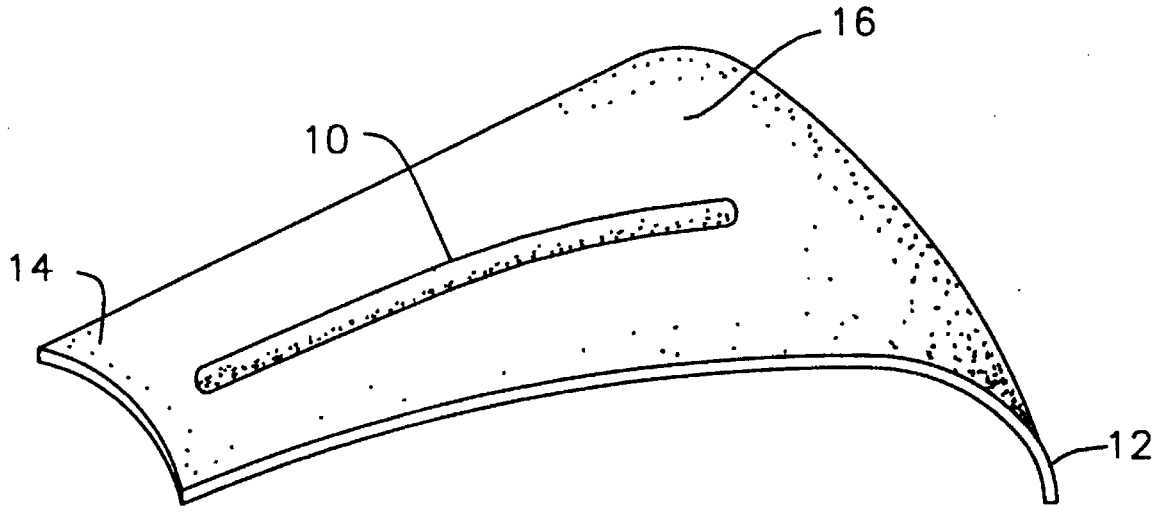
FIG. 4 is a perspective view of an individual panel of the tank head insulation cover of FIG. 2.
Figure 5:
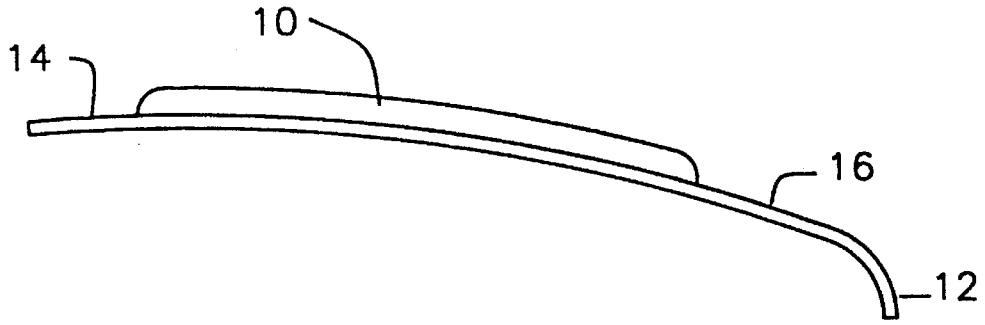
FIG. 5 is an end view of the individual panel of FIG. 4.

The panels 6, which are shown in detail in FIGS. 4 and 5, are generally wedge shaped when viewed from the top plan, with a portion at the narrower end truncated. The diameter of the end of the tank 2 is 88", which yields a circumference of approximately 276'. The shape and size of each panel 6 is such that each will provide coverage over approximately 28" of the circumference; ten such panels 6 are thus required to fully cover the end of the tank 2. Each panel 6 overlaps the adjacent panel 6 by approximately 2" to 2½". As shown in FIG. 3, the chord 7 which is formed along the circumference from one radius end to the other is thus approximately 31".

The side view of the panel 6 shown in FIG. 5 illustrates how the panel 6 curves downwardly from the narrower end 14 to the wider end 16, and terminates in a flange section 12 which extends downwardly. The flange section 12 will fit snugly over the tank 2 when the panel 6 is installed thereon.

Each panel 6 comprises optionally a centerline rib 10 running along its radius which may be used to provide strength if desired, and also to locate the panel properly by pointing the rib towards the center point of the tank end.

After each panel 6 is attached to the end of the tank 2, which will be described in detail below, the circular cap 8 is fitted over the area left uncovered in the middle of the end of the tank 2. The cap 8 of the preferred embodiment has a 12" to 48" diameter and overlaps the panels 6 by approximately 4'.

The panels 6 are fabricated from PVC, modified PVC or CPVC due to the inherent chemical and fire resistant properties and are thermoformed during fabrication to conform intimately to the curved shape as desired. PVC, foamed or non-foamed, is preferred since it has good chemical and fire resistance and is permanently sealable without heat or welding by using water based or solvent based adhesives. In the preferred embodiment, outdoor grade PVC or PVC marketed as LOSMOKE® PVC is used, with a thickness of approximately 0.040" to 0.125" depending upon the size and position of the particular application.

Alternatively, any thermoformable material can be used, or fiberglass polyester layup or drawn aluminum or other metal. Further, the panels can be fabricated from a composite marketed as VINALUM®, which is a composite of approximately 0.002" to 0.005" soft aluminum fused to thick rigid PVC approximately 0.06" to 0.10" thick. This composite is described in U.S. Pat. No. 5,030,504 to Botsolas.

Practice has shown that a foamed version of PVC approximately 0.090" thick containing approximately 0.20" thickness of solid PVC on the exposed surface is preferred. This 0.090" thick sheet is foamed up from material that normally would be approximately 0.050" thick, or 45% thicker for the same weight. Foamed PVC is described in U.S. Pat. Nos. 5,049,590 and 4,981,630 to Botsolas.

Another version of foamed material would be PVC or modified PVC with a thin skin, for example 0.010" thick on each side of the center core foam material. This yields a stiffer panel of lighter weight, for ease of handling.

The panels 6 and cap 8 of a particular fixed size can be used to cover the ends of tanks 2 with different diameters. Due to the overlap of each panel 6 with the adjacent panel 6 and with the cap 8, the panels 6 can be pulled outwardly to fit a tank end with a larger diameter or inwardly to fit a tank head with a smaller diameter and still provide complete coverage thereof.

Practice has shown that due to the versatility in coverage provided by the overlapping of the panels 6 and the cap 8, only eight different sized sets of panels 6 and caps 8 are required to cover tank heads ranging in size from 4'6" to 12' in diameter. In addition, these eight sets of panels 6 and caps 8 can cover any of the six different tank head shapes shown in FIG. 6 with a diameter in this range. One hundred and fifty-three combinations of tank end sizes with various insulation thickness can be covered with only four different shaped molds. FIGS. 7 can also be done using eight mold shapes for each of these Figures. Approximately six hundred and twelve possible combinations can be insulated and jacketed within thirty-two segment shapes.

Whereas the tank head shapes shown in FIG. 6 differ from each other only slightly, the tank head shapes in FIG. 7 are dramatically different from each other. Thus, eight different sized sets of panels 6 and caps 8 would be required for each of these types of tank heads, each set capable of covering the tank heads with a diameter ranging from 4'6" to 12'.

Panels 6 can be fabricated with thermoformed guide lines in order to aid in cutting at the correct angles for various sized tank heads.

Installation of the head cover 4 can be accomplished in a variety of ways. In the preferred embodiment, each panel 6 is provided with double sided adhesive tape 2" to 4" wide on the underside thereof. The adhesive tape facilitates adhesion of the panel 6 to the adjacent panel 6 or directly to the insulation. If desired, the entire underside surface can be provided with such double sided adhesive tape for increased adhesive properties. In the alternative, the underside surface of the panels 6 may be coated with a contact adhesive. Further, the panels 6 can be assembled by adhering each one to the insulation material with a caulk adhesive; the entire head cover 4 can then be screwed in place after all panels 6 and the cap 8 have been assembled.

Figure 6A:
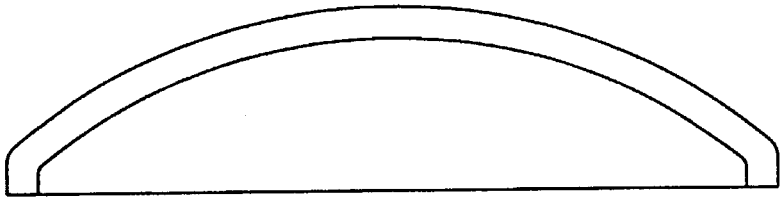
FIGS. 6A to 6F illustrates the various shaped tank heads which can be covered by the tank head insulation cover of FIG. 2.
Figure 6B:
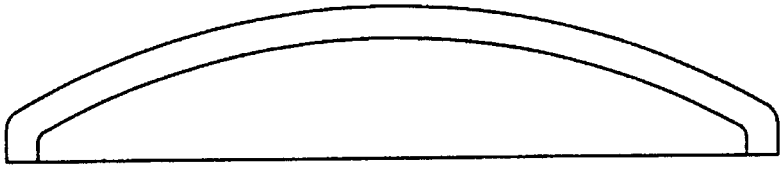
Figure 6C:
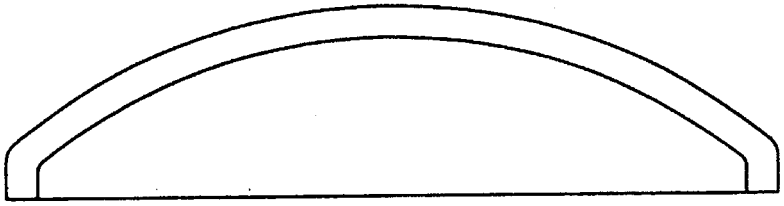
Figure 6D:
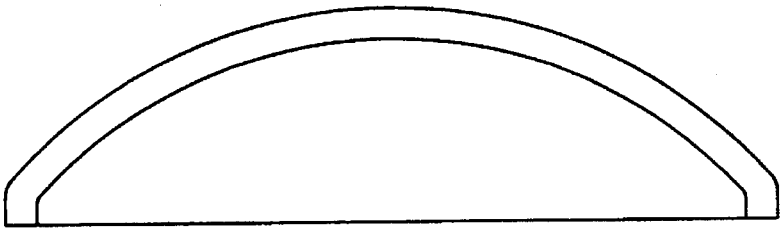
Figure 6E:
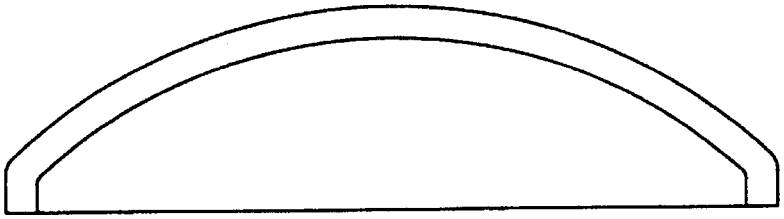
Figure 6F:
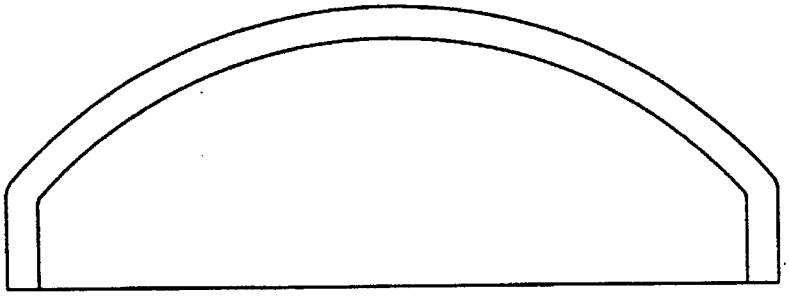
Figure 7A:
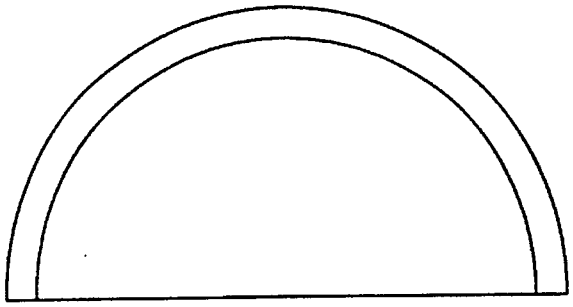
FIG. 7 illustrates heads that are shaped radically different than those of FIG. 6, which heads will require separate mold shapes in order to conform to various sizes of these shapes; all other features of this invention will apply.
Figure 7B:
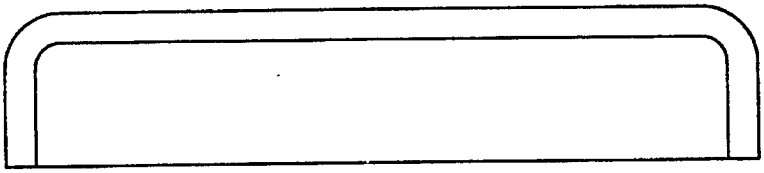
Figure 7C:
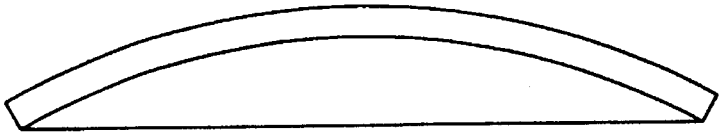

Practice has shown that in the case of the hemispherical head of FIG. 6F and the full hemispherical head of FIG. 7A, thermoformed material that has been formed to the compound shape of the hemisphere can be easily applied by using adhesive caulking such as the type used for gluing plywood to walls. Temporary tack fasteners can then be pushed in place to hold any thermoformed panel of convenient size, e.g. 4' by 6'. A caulk adhesive such as CELULON® is applied over and under all seams, which fuses one panel to the adjacent panel. The entire cover is fused into a singular composite unit in this fashion.

An alternative method of fabrication can be implemented when the insulation material is carved or molded perfect segments of urethane foam, foamglass or ground compound curved segments of any other type. In this case, the panels 6 can be adhered at the factory to the insulation segments and delivered as a unit to the jobsite for installation. Weld pins are inserted through the unit and welded to the tank. Caulk adhesive such as CELULON® can be applied over the welded pin fastener washers, thereby allowing quick, dry installation to be completed at about three times the speed than with conventional methods.

In an alternative embodiment, the panels 6 and the cap 8 are fabricated from PVC thermoformed foam between 0.25" and 1" thick. These thick panels 6 function as both insulation and protective covering simultaneously. In this embodiment, it is preferred to precision cut each panel 6 to fit the adjacent panel 6 with a butt seam rather than an overlap seam. The butt seams are then caulked to prevent leaks.

While the present invention has been described in connection with the exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. An apparatus for covering tank heads of varying sizes comprising:

(a) a plurality of substantially rigid wedge-shaped panels comprised of a thermoformable plastic that is fabricated to conform intimately to the shape of the tank head, a pair of sides joined at one end by a convex base and converging towards an adjoining inner base, the convex base conforming substantially to an arc along the circumference of the tank head and a flange extending obliquely from said convex base and conforming snugly to the perimeter of the tank, the panels arranged adjacently in overlapping fashion so as to substantially cover the tank head, wherein the panels are solid and the edges are flat so that a particular set of panels can be used to cover various sized tank heads by varying the degree to which each panel overlaps the next; and (b) a cap for covering the center of the tank head left uncovered by the plurality of panels.

2. The apparatus of claim 1 wherein the panels comprise a rib extending down the panel center line for providing increased strength to the panel.

3. The apparatus of claim 1 wherein the panels are comprised of PVC.

4. The apparatus of claim 1 wherein the panels are comprised of thick thermoformable foam plastic up to 1" thick.

5. The apparatus of claim 4 wherein the panels further comprise a solid skin of PVC, aluminum or other suitable plastic which is adhered, co-extruded or laminated to one or both sides thereof.

6. The apparatus of claim 1 wherein the panels are comprised of a composite of soft aluminum fused to thick rigid PVC.

7. The apparatus of claim 1 wherein the panels are provided with thermoformed guide lines in order to aid in cutting at the correct angles for various sized tank heads.

8. The apparatus of claim 1 wherein the panels are provided with double faced adhesive material which is used to facilitate the assembly of the cover.

9. The apparatus cover of claim 1 wherein the number of panels is 10.

10. An apparatus for covering tank heads of varying sizes comprising:

(a) a plurality of substantially rigid wedge-shaped panels comprised of a pair of sides joined at one end by a convex base and converging towards an adjoining inner base, the convex base conforming substantially to an arc along the circumference of the tank head and a flange extending obliquely from said convex base and conforming snugly to the perimeter of the tank, the panels are solid with flat edges arranged adjacently in overlapping fashion so as to substantially cover the tank head, wherein a particular set of panels can be used to cover various sized tank heads by varying the degree to which each panel overlaps the next; and (b) a cap for covering the center of the tank head left uncovered by the plurality of panels, wherein the panels and cap are fabricated from polyvinyl chloride, modified polyvinyl chloride, chlorinated polyvinyl chloride, VINALUM®, or foamed polyvinyl chloride which is about 0.010 to about 0.125 inches thick and are thermoformed during fabrication to conform intimately to the shape of the tank head.

11. An apparatus as defined in claim 10 wherein the number of panels is 10.

12. An apparatus as defined in claim 11 wherein each panel is defined by a chord of approximately 31 inches formed along the arc of the convex base of the panel from one side of the panel to the other side of the panel.

13. An apparatus as defined in claim 10 wherein the panels are provided with thermoformed guide lines in order to aid in cutting the panels at correct angles for various sized tank heads.

* * * * *